United States Patent [19]

Preisig

[11] 3,943,681

[45] Mar. 16, 1976

[54] METHOD AND DEVICE FOR PACKAGING BOX FLATS

[75] Inventor: Roland Preisig, Yens, Switzerland

[73] Assignee: J. Bobst & Fils SA, Prilly, Switzerland

[22] Filed: June 20, 1974

[21] Appl. No.: 481,176

[30] Foreign Application Priority Data

June 29, 1973 Switzerland ..... 9497/73

[52] U.S. Cl. ..... 53/35; 53/156; 53/164; 53/244; 53/247

[51] Int. Cl.[2] ..... B65B 5/06

[58] Field of Search ..... 53/35, 247, 248, 159, 156, 53/164, 255, 258, 244, 201, 236; 93/51 HW

[56] References Cited

UNITED STATES PATENTS

| | | | |
|---|---|---|---|
| 2,921,506 | 1/1960 | Johnson | 93/51 HW |
| 3,299,613 | 1/1967 | Cella | 53/247 |
| 3,404,509 | 10/1968 | Schaewe et al. | 53/247 X |
| 3,530,640 | 9/1970 | Hoffmann | 53/159 X |
| 3,543,476 | 12/1968 | Jaroff et al. | 53/164 X |
| 3,592,002 | 7/1971 | Alduk | 53/247 X |
| 3,641,735 | 2/1972 | Dailey et al. | 53/164 X |
| 3,653,178 | 4/1972 | Bauer | 53/159 |
| 3,660,963 | 5/1972 | Sullivan | 53/201 X |

*Primary Examiner*—Travis S. McGehee
*Assistant Examiner*—Horace M. Culver
*Attorney, Agent, or Firm*—Hill, Gross, Simpson, Van Santen, Steadman, Chiara & Simpson

[57] ABSTRACT

A method and apparatus for assembling flats for folded boxes into a container for shipment and storage which comprises the steps of positioning a container under an opening having a slidable closure which is in a closed position, positioning a sheet of divider material over the slidable closure, positioning a plurality of stacked flats on top of the divider material in a defined space, applying a weight to the stack flats, cutting the divider material to size, opening the slidable closure and dropping the divider material, flats and weight into the container and thereafter removing the weight.

5 Claims, 9 Drawing Figures

METHOD AND DEVICE FOR PACKAGING BOX FLATS

BACKGROUND OF THE INVENTION

1. Field of the Invention

This invention relates to methods and devices for boxing packets of folded box flats automatically.

2. The Prior Art

Box flats, particularly flats which are capable of being folded to form product containers, can be automatically produced by known folding and gluing machines. These flats are generally assembled into stacks or packets. In the past, it has been known to tie these packets, by means of streamers, and to arrange the packets in a container. This has generally been done manually and the tying operation always necessitates the use of special tying machines. In addition to the requirement of special machinery, the streamers must be removed by the user when the box is placed in a boxing machine which required additional handling. Up until now, if it was desired to avoid tying the packets with streamers, the flats for the boxes had to be secured in a stack which was straightened and manually arranged in the shipping container, generally on a sheet of separator paper whose edges are folded back to enable the flats to be removed from the container.

Recently, new machinery and methods have been devised to eliminate the need to handle packets of untied boxes. The packets are pushed horizontally by a ram mechanism into a container which rests on its side. An automatically cut strip of separator paper is also provided at the time the packets are pushed into the container. This method, which in many respects improves upon the prior manual methods has a disadvantage in that if the containers into which the packets are fed are thereafter set upright for transport and storage, the flats contained therein will not rest on a long side or on a comparatively rigid fold side, but may come to rest on an end tongue generally made up of the end of a small flap or tongue which does not always have sufficient strength and resistance to support the weight of the packet or, more particularly, the weight of another layer of packets. Thus, during the shocks of transportation and handling, the individual folded boxes stored in the container can deteriorate which not only damages the flats themselves, but can lead to difficulties in removing the packets of flats from the container. Thus it would be an advance in the art to provide an automatic packaging system for flat folded boxes which packages the flats in a container in a stable support position where they do not lie on an end tongue and in a manner which they are easily removable from the container requiring a minimum of handling both for removal and insertion into an automatic boxing machine.

SUMMARY OF THE INVENTION

My invention is essentially aimed at removing the above mentioned disadvantages and insuring a boxing operation which is similar, in many respects, to manual boxing and which results in the boxes resting on a rigid, resistant fold.

According to this invention, a method is provided in which a sheet of paper is spread on a plain, horizontal support located above the container into which the flats are to be fed. Packets of boxes are assembled onto the sheet of paper in a proper position. Thereafter an evenly distributed weight is placed on the packet and the horizontal support is then removed in such a way that the weight falls into the underlying container carrying with it the packet of boxes and the paper while automatically folding the ends of the paper against the sides of the packets.

In the practice of this invention, the weight must be carefully chosen, but this choice can be made from a relatively wide range. If the weight is too high, it can crush the boxes however, the weight must be sufficient that it will fall more quickly than the boxes themselves. The difference in falling rates between the boxes and the weight arises from the fact that the boxes have a large surface area with respect to their mass and are therefore greately influenced by air resistance and will tend to a non-linear fall somewhat in the manner of a feather whereas the weight, having a greater mass to surface area will tend to fall directly pushing the air out of its way. In this manner the weight will maintain the packet, that is to say the weight will accompany the falling packet in its fall into the container. The weight's function is therefore comparable to that of a moving stop as opposed to that of a push rod. Additionally, the role which the separator sheet of paper performs is essential and aids in properly boxing the packets. This may be explained, in part, by the fact that the separator paper traps air between it and the container. This air has the effect of a buffer which holds the packets of boxes against the descending weight. The packets will therefore be kept between the weight and the air in the container during the fall into the container. Surprisingly, the implementation.

A device capable of functioning according to the above described method includes a removable support device, means for feeding an interposed sheet of separator paper onto the support, means controlling opening and closure of the support, at least two parallel vertical walls positioned adjacent the support to retain the ends of the packet of boxes, a movable weight member whose lower half runs parallel with the support and means for guiding the weight in its descent and additional means for lifting the weight.

It is therefore an object of this invention to provide an improved method and device for automatically packaging flats for folded boxes in a container with the flats resting on a rigid edge.

It is another and more specific object of this invention to provide structure for packaging folded box flats in a container with the flats resting on a folded edge.

It is yet another and more specific object of this invention to provide a device and mechanism for packaging packets of folded box flats in a container by dropping the flats from a removable support by gravity under influence of an applied weight into a container positioned below the removable surface.

BRIEF DESCRIPTION OF THE DRAWINGS

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure and in which.

DESCRIPTION OF THE PREFERRED EMBODIMENTS

The boxing device of this invention is most advantageously designed in the form of an independent unit capable of being temporarily positioned adjacent a station for receiving flats for folded boxes coming from a folding and gluing machine. For the purposes of this document, the flattened unopened boxes from the folding and gluing machine will be referred to as flats; and arranged together stack of flats suitable for packing will be referred to as a packet; and, the box or other storage device into which they are packed will be referred to as a container.

Figure 1:
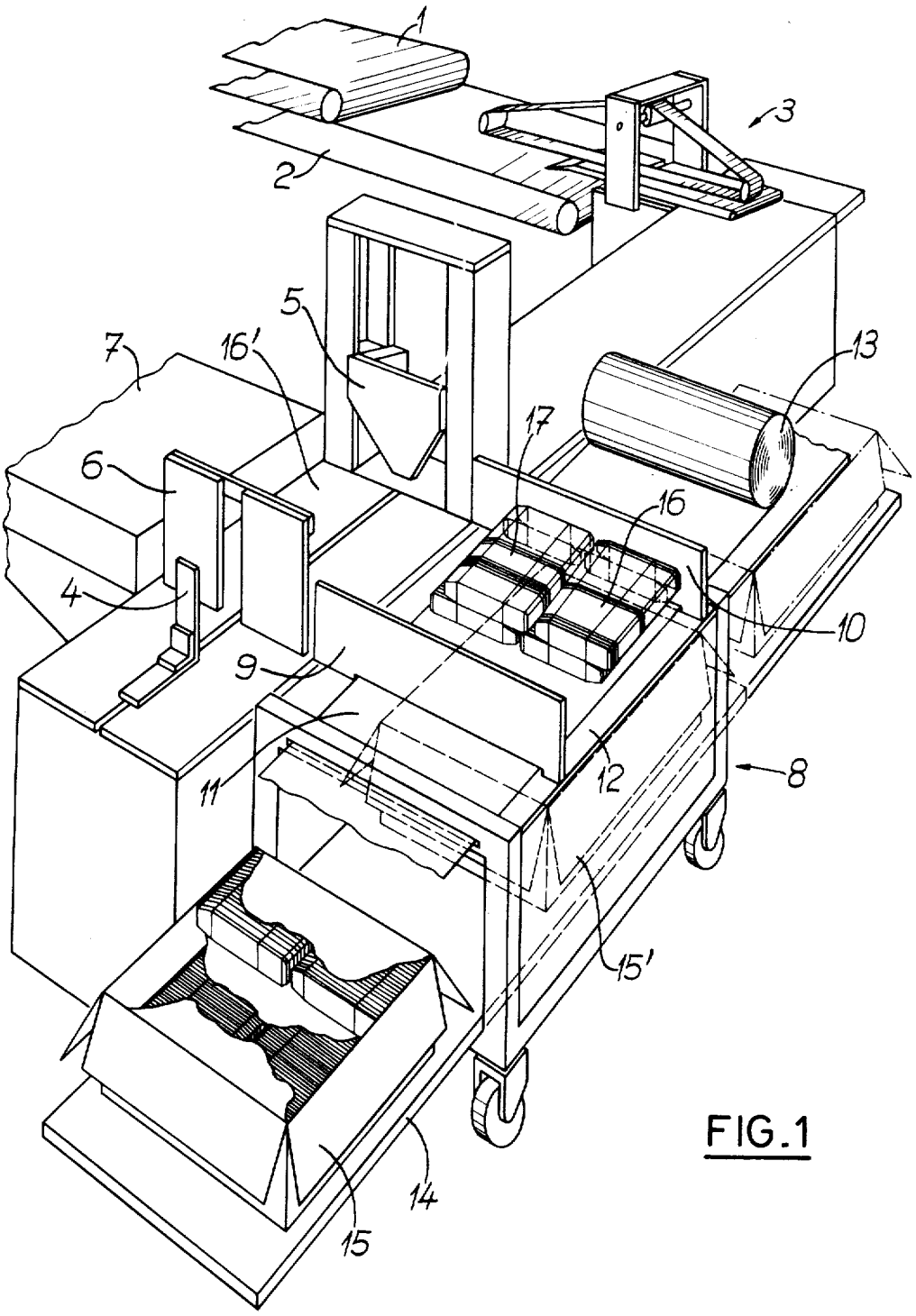
FIG. 1 is a schematic diagrammatical view of a flat packaging device according to this invention in position adjacent a folding-gluing machine.

The diagrammatic FIG. 1 illustrates a typical production layout utilizing the independent boxing device of this invention. The figure shows a reception station from a piece of machinery engaged in the production of flats which includes two belt conveyors, 1 and 2 which feed the flats into a conveyor device 3 which in turn results in the flats being deflected 90° and straightened to form a stack of flats against a movable stop 4. Packets are formed from the stack of flats by means of a vertically movable separator 5, the length of individual packets being determined by an adjustable stop 6. The packets may then be pushed in a lateral direction by a push rod mechanism 7 as has been previously described in my U.S. Pat. No. 3,826,058 entitled "A Method and Apparatus for Inter-Leaving a Strip of Material Between Superposed Packets" the teachings of which are herein incorporated by reference. The boxing device itself is positioned to receive the packets pushed by the push rod 7 and consists of a movable unit 8, which may be mounted on wheels for easy displacement. The unit includes two vertical parallel walls 9 and 10, which may be adjustable, a surface which is defined by two movable flaps or support surface members 11 and 12, a weight mechanism (not shown in FIG. 1) which is designed to accompany the packets of flats in a fall from the surfaces 11 and 12, a roll of paper 13 for providing a divider material interposed between successive layers of packets, and a plate 14 extending under the movable support surfaces 11 and 12 and designed to support containers 15.

The boxing operation can be carried out as follows:

After separator 5 has been lowered and a packet of boxes has been assembled on surface 16′ the packet is fed by push rod 7 onto the top of a strip of paper previously fed over the movable support surfaces 11 and 12. As illustrated, two packets of flats 16 and 17 can be fed in succession onto the strip of paper or divider material over the movable support surfaces 11 and 12 which thereby allows, in a single operation, the formation of a complete bed or layer of packets in a large container 15′ positioned under the movable support surfaces. Once the two packets 16 and 17 are positioned atop the movable support surfaces and between the vertical walls 9 and 10, the weight device is lowered onto the packets 16 and 17. At the same time, the strip of interposed divider material 13 previously placed on the surface of the movable support surfaces is cut to the desired length. Thereafter the movable support surfaces 11 and 12 are quickly separated. The packets of flats 16 and 17 and the cut-to-length divider material 13 then fall into the container 15′ accompanied by the falling weight member. The packets are at first guided by the vertical walls 9 and 10 and thereafter by the walls of the container 15′ and are kept aligned at the top by the accompanying weight member and at their bottom by the air pressure of air trapped between the descending divider material and the container. Although it is mandatory that the container provide an opening whose dimensions are at least equal to those of the descending packets between the walls 9 and 10, it may desirably be slightly oversized having a length dimension greater than the length of the packets to allow slight expansion of the packets in the container.

The interposed paper is automatically carried by the falling packets and preferably has a dimension, after cutting, greater than the dimension of the packets. In this manner the ends of the divider material are folded at various points on the packets as the packets enter the container to permit easy removal of packets from the container. The above described operation is repeated as many times as is possible to provide beds or layers of packets in the container. Between each drop of packets and divider material into the container, the weight mechanism is raised by a suitable means and the movable support surfaces are moved to a closed position. The movable support surfaces 11 and 12 may be separated from one another in various ways, the simplest of which is to slide them horizontally under influence of devices such as air cylinders, solenoids, hydraulic rams, etc.

Referring now to FIGS. 2 through 8, the movable unit 8 is illustrated as being wheel-mounted with the table being composed of two horizontally movable slidable support surfaces members 11 and 12. Extending above the members 11 and 12 are the two vertical parallel walls 9 and 10 which, although shown as being in fixed position, are preferably adjustable to provide for differing size packets. Walls 9 and 10 are positioned on a frame 18 and are interconnected by a third vertical wall 19 which serves as a stop for the packets which are fed onto the table surface formed by the members 11 and 12 by the push rod 7. A third closable wall 20, formed in the shape of a U, also extends between walls 9 and 10. The bight portion of the U acts as a fourth side to a defined space the other three sides of which are defined by walls 9, 10, and 19. The legs of the U are hingeably attached to the walls 9 and 10 and are fixedly attached to, for example, shaft 25 which is rotatable under influence of an outside motive force to open and close the vertical wall 20. The slidable support surface members 11 and 12 slide in grooves 21 and 22 in walls 9 and 10 and may be moved by, for example, the double action rams 23 and 24 illustrated.

The frame member 18 is also provided with a bracket or table bed extension 26 designed to support the reel of paper 13.

Figure 2:
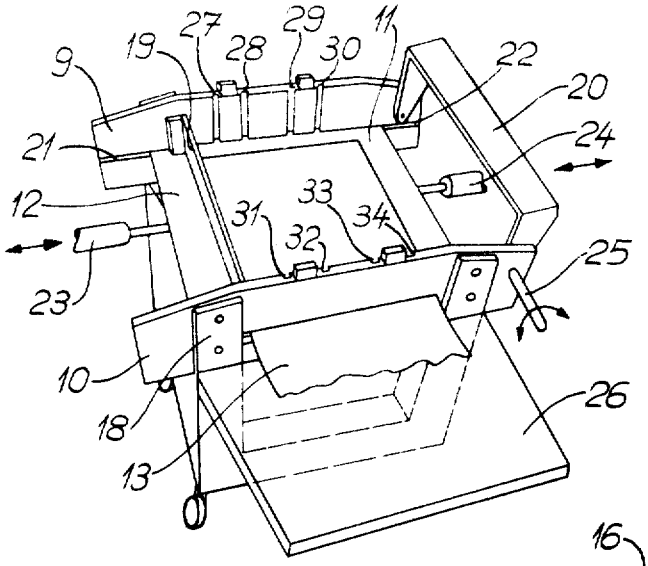
FIG. 2 is a perspective diagrammatic view of portions of the packaging device of this invention.
Figure 3:
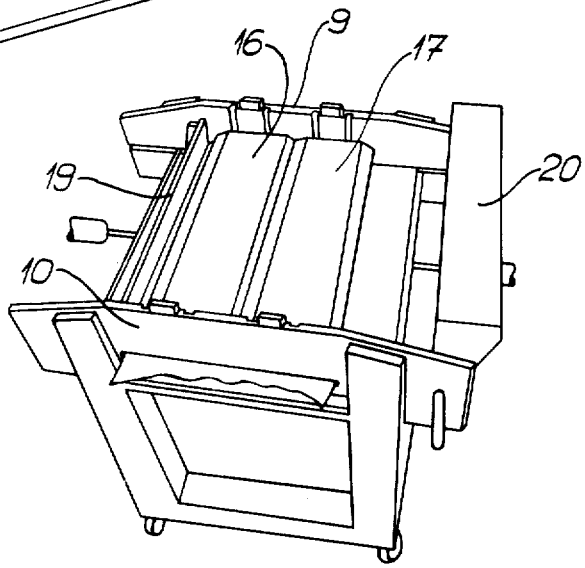
FIG. 3 is a view similar to FIG. 2 illustrating two rows of flats in position on the device of FIG. 2.
Figure 4:
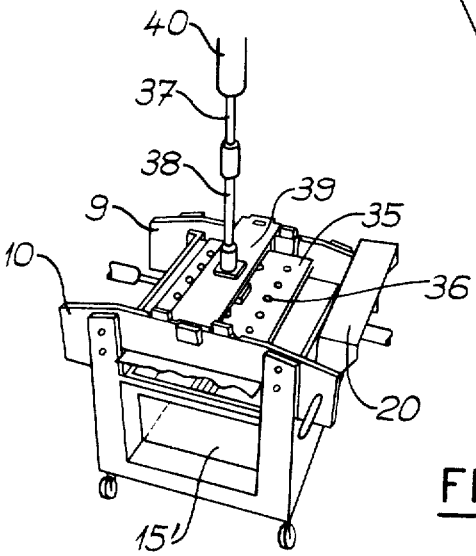
FIG. 4 is a view similar to FIGS. 2 and 3 illustrating diagrammatically the weight applying mechanism of this invention.
Figures 5, 6:
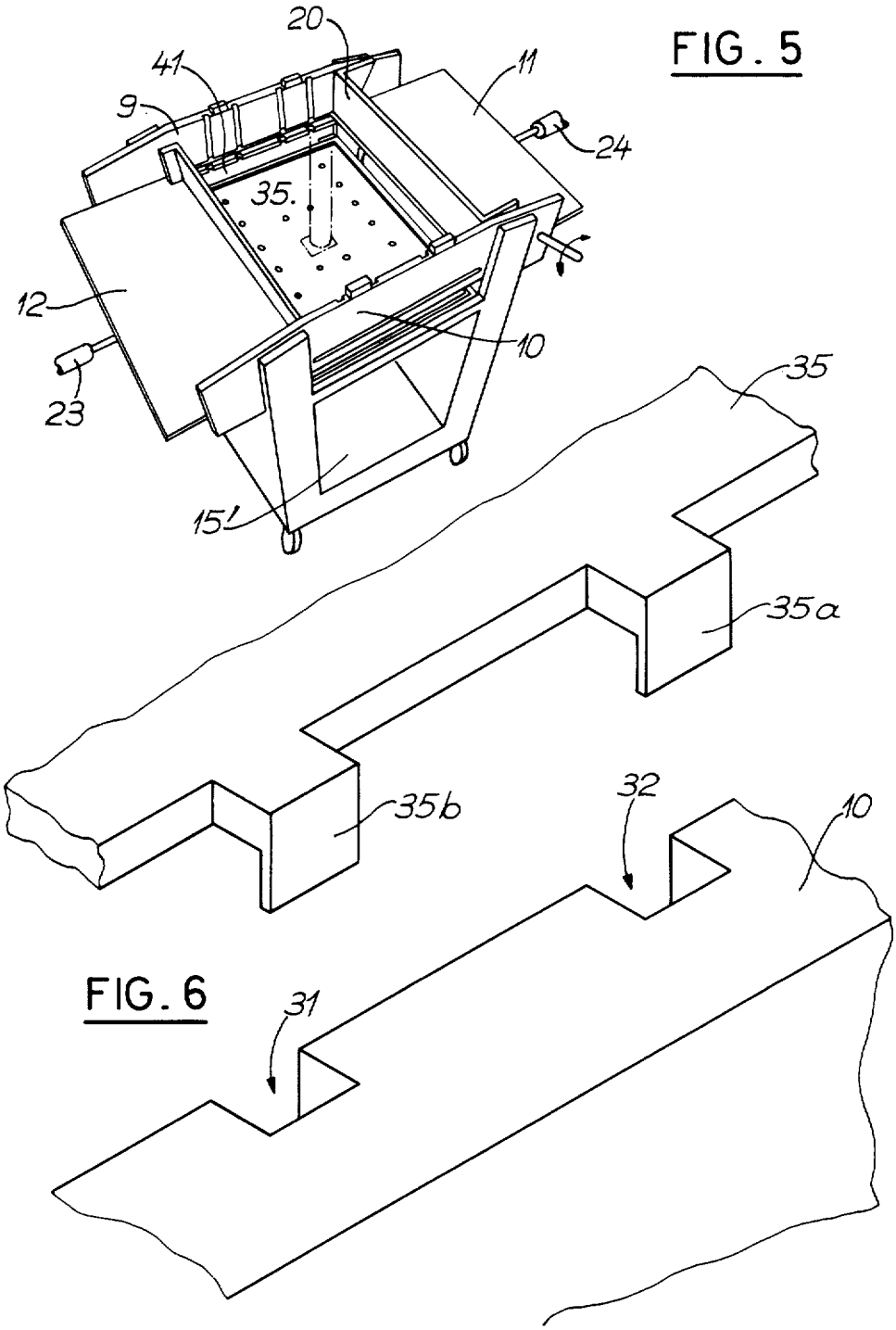
FIG. 5 is a view similar to FIGS. 2, 3, and 4 illustrating the device after removing the support surface.
FIG. 6 is a perspective view of a portion of the interfit between stationary walls of the device and the movable weight.

FIG. 4 illustrates the placement of a weight applying assembly for use in the practice of this invention. The assembly includes a weight plate 35 which may be provided with perforations 36 allowing air to pass therethrough. The plate is affixed to the lower end of a piston 37 guided in a vertical tube 38 which in turn is affixed to a support plate 39 carried by walls 9 and 10. The piston 37 is activated by a member 40, which may be, for example, a hydraulic cylinder, solenoid, rack and pinion or the like power actuator which is capable of raising the plate 35 to an elevated position and maintaining it in that position and further, which is capable of releasing the plate. As shown in FIG. 6, the plate 35 is provided with eight shoulders, two of which 35*a* and 35*b* are shown which are bent at right angles to the plate and depend therefrom. These shoulders engage grooves 27 to 34 as illustrated in FIG. 2, grooves 31 and 32 being shown in FIG. 6. The vertical flange portion of the shoulders 35*a*, 35*b* are recessed from the surfaces of walls 9 and 10 when received in the grooves.

Referring now to FIGS. 2 through 6, it can be seen that once wall 20 is raised into the feed position shown in FIG. 2 and the interposed paper or divider material 13 is fed onto the movable support surfaces 11 and 12, the packets of flats 16 and 17 can be pushed in succession onto the surface members 11 and 12 over the divider material 13 under wall 20. The packets will be restricted between walls 9 and 10. Thereafter wall 20 is rotated down to the position illustrated in FIG. 5 to define a confined space for the packets. Support surfaces 11 and 12 are quickly separated by action of the members 23 and 24. The plate 35, having been previously released from its elevated position to a position resting atop the packets, then falls, more or less freely, and accompanies the packets in their fall into container 15'. During the fall, the flats located at the ends of the packets tend to be held by friction against the walls 9 and 10. Since it is necessary to allow a slight clearance between the edges of plate 35 and the walls 9 and 10, the end flats tend to remain held against the walls without being carried forward by the plate 35. The grooves 27 to 34 and the indexing shoulders 35*a*, 35*b*, etc., cooperate to prevent the flats from being held in place against the walls in that they will be abutted by the shoulders. The end flats must also bridge the necessary and relatively large space between the table bed and the container 15'. In this critical space, the packets, which are compressed, have a tendency to expand. Although the divider material 13 which moves downwardly with the packets retains the lower edge of the flats, particularly the end flats, the upper edges, in contrast, tend to separate which could cause the end flats to tip over, possible carrying therewith adjacent flats. The vertical flanges of the shoulders 35*a*, 35*b*, etc., prevent this from occuring by retaining the upper edges of the end flats.

Figure 7:
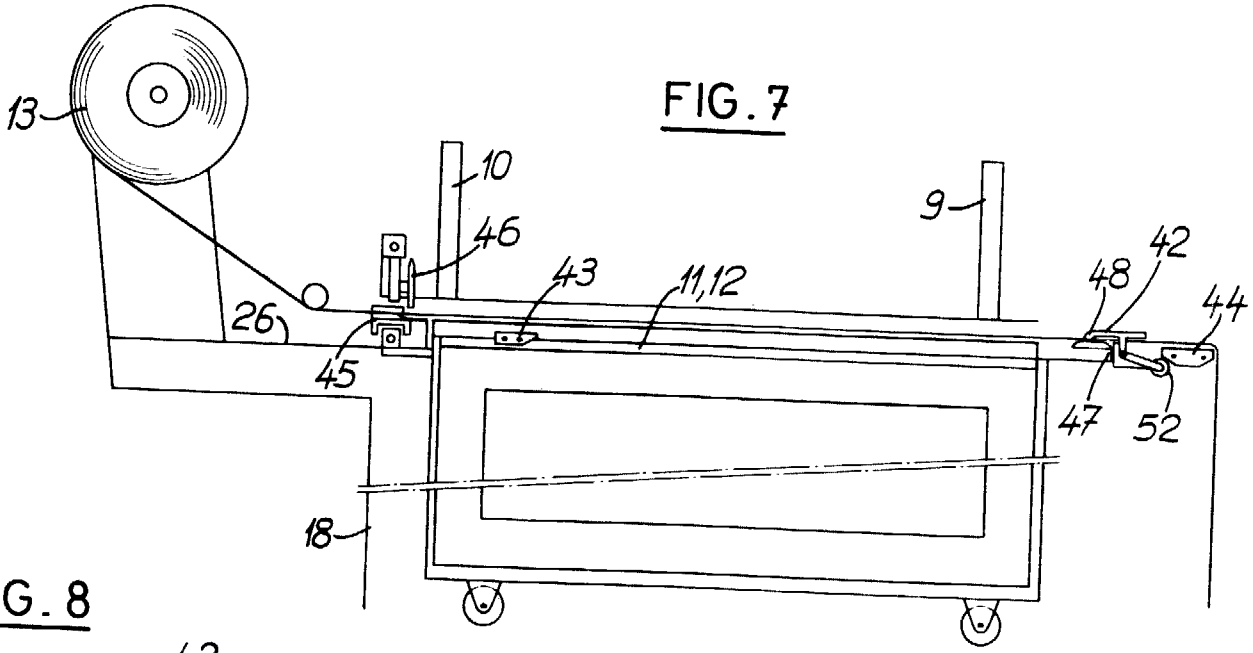
FIG. 7 is a diagrammatic view of a divider material cutting device shown in position with respect to the boxing device of this invention.
Figure 8:
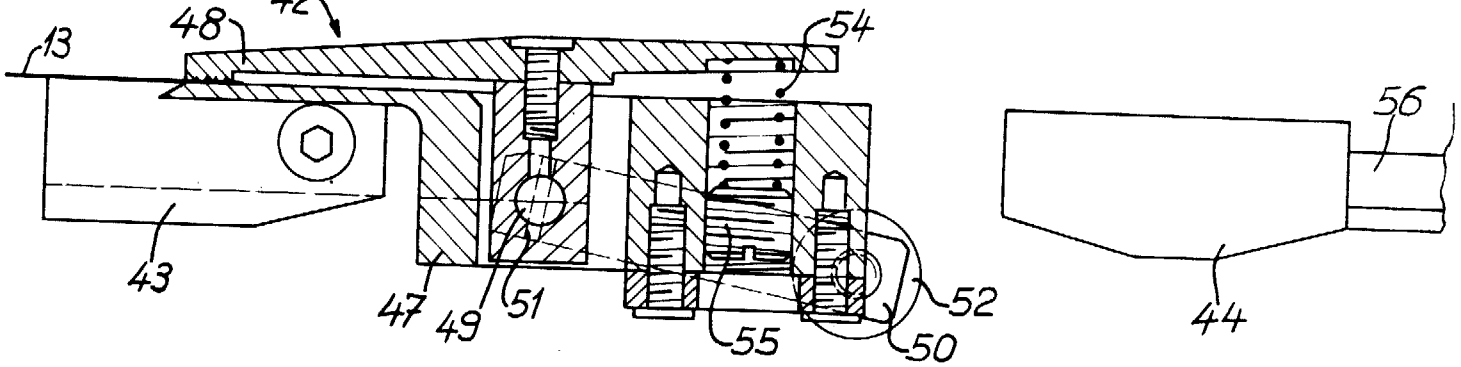
FIG. 8 shows structural details of the divider material cutting device of FIG. 7.

FIGS. 7 and 8 illustrate a device for positioning and cutting the divider material or paper 13. FIG. 7 diagrammatically illustrates the device as seen from the receiving station 16' of FIG. 1 in a direction parallel to walls 9 and 10. The movable support surfaces 11 and 12, the bearing surface 26 of the frame 18 and the paper reel 13 are all illustrated. The device for positioning the divider material includes a gripper 42 capable of being displaced from one end to the other in parallel with the movable support members 11 and 12 and whose opening and closing operations are controlled by cams 43 and 44, cam 43 being mounted on a slide perpendicular to the plane of the drawing. To the left of the drawing at the side of the reel of paper 13 a paper knife 45 including a blade 46 controlled by a cam (not illustrated) is positioned.

FIG. 8 illustrates, in greater detail, the gripper 42 and its control cams 43 and 44. The gripper consists of a fixed jaw 47 and a movable jaw 48. The movable jaw 48 is associated with a shaft 49 with which it pivots. A lever 50 is fixed at another point on the shaft by means of a pin 51. The end of the lever is provided with a roller 52 designed to operate with cams 43 and 44. These cams are outside of the trajectory of the gripper but on the trajectory of roller 52. The locking force of the gripper can be adjusted by means of a screw 55 which acts upon a spring 54. At least one of the cams, for example cam 44 controls the opening operation of the gripper at the end of its travel in a manner which releases the paper 13. To this end the cam 44 may be moved on a slide 56 and locked into the desired position. The length of the paper spread on the moving support surfaces 11 and 12 must be adapted to the length of the packets of flats received thereon.

The gripping mechanism operates as follows:

To grip the paper, gripper 42 is moved towards the left in the drawing. When its roller 52 meets cam 43, the gripper will open. Thereafter cam 43 is laterally moved, for example by the action of a pneumatic cylinder (not shown) in such a way that the roller 52 leaves the cam thereby allowing the gripper to be closed by action of the spring 54. In so doing, it will grip the end of the strip of paper 13 to the left of the knife 56. The gripper will then return to the right in the drawing carrying with it the sheet of paper or divider material 13 without the roller 52 engaging the cam 43 which, during this movement, remains displaced and returns to its initial position only after the gripper has passed. Immediately before the roller 52 meets cam 44 which will act to release the gripper, the paper will be cut by knife 56 which is actuated by a suitable control mechanism which may, for example, be mechanically tied into the movement of the gripper. Thereafter the packets of flats can be pushed onto the surface of the divider material above the movable support surfaces 11 and 12. Thereafter the weight represented by plate 35 can be lowered into contact with the packets as illustrated in FIG. 4. It will be noted that the paper preferably has a length, after cutting, which is greater than the packets which are received between the walls 9 and 10. Thus, the paper is preferably of greater dimension after cut than the opening to the container 15'. In this manner, when the movable support surfaces 11 and 12 are removed and the paper dividing material 13, packets 16 and weight 35 descend into the container 15', the divider material 13 will be bent to provide easy removal of the packets from the container.

Figure 9:
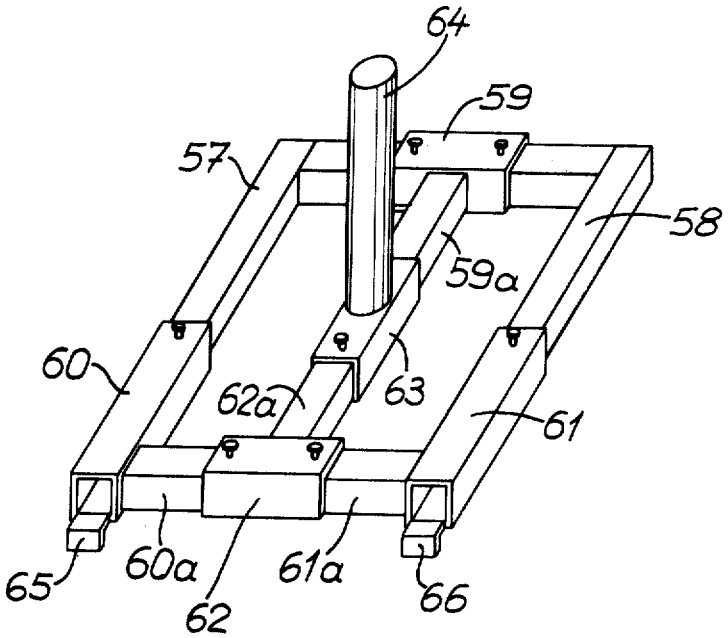
FIG. 9 shows an alternative design for the weight applying portion of the packaging device of this invention.

It is to be understood that the devices thus far described are merely illustrative of one possible embodiment. As an alternative embodiment, the movable support surfaces 11 and 12 could be replaced by some other movable support surface in one or more sections. Further the separation or removal of the support may be carried out by a rotary movement or a combined rotary and transverse movement, the support surfaces being guided on rails of suitable curvature. In addition the removable support surfaces might in particular consist of a cloth or cover mounted on rollers or chains. It may also be advisable to alter the dimension of the weight according to the size of the packets of the boxes and the dimensions of the container. For this purpose the weight may consist of a telescopic rod assembly enabling its horizontal dimensions to be altered or any such similar system that can be extended in one or more planes. One such alternative design is illustrated in FIG. 9 wherein the weight comprises two tubular parts 57 and 58 bent at right angles encasing and sliding on the one hand in a tubular part 59 and on the other hand, in tubular parts 60 and 61 which may themselves be provided with bent section 68, 61*a* respectively and slide in a tubular part 62 parallel with part 59. Parts 59 and 62 are each firmly attached to cross pieces 59*a*, 62*a* respectively which slide in a tubular part 63 attached to a shaft 64, which could be the equivalent of the shaft 38. The various parts are locked together in the desired dimension by means of set screws illustrated or by other such adjustable fasteners. Shoulders 65 and 66 similar to shoulders 35*a* and 35*b* are provided at each end of the frame.

It can therefore be seen from the above that my invention provides both a method and device for boxing packets of box flats in a container for shipment or storage. The flats are boxed in a manner mosts desirable for assuring their protection from damage during shipment and storage. Of particular importance, the device provides an area defined by walls into which packets can be automatically fed over a sheet of divider material which is cut to size automatically. The divider material is positioned over a removable support surface. A container underlies the support surface. A weight is provided to automatically descend atop the packets to retain them in position during a fall into the container which is actuated by removal of the support surface. In addition interfitting flanges on the weight and grooves on at least one of the side walls cooperate to prevent the packets from falling apart during the drop to the container. In this manner it is not necessary that the individual flats making up the packets be tied together.

Although the teachings of my invention have herein been discussed with reference to specific theories and embodiments, it is to be understood that these are by way of illustration only and that others may wish to utilize my invention in different designs or applications.

I claim as my invention:

1. A device for packaging folded box flats comprising: a frame member, a first surface associated with said frame member for receiving a container thereon, a second surface carried by said frame member positioned vertically above the said first surface, said second surface including a movable surface portion, means for moving the surface portion to and from an area over a container on the first surface, vertical walls defining an area above said second surface, means for positioning a sheet of divider material on said movable surface portion, means for positioning packets of a plurality of individual box flats on said sheet of divider material, a movable weight positionable at a first position on said packets, means allowing said weight to freely fall from said first position to a second position adjacent the first surface, means limiting movement of said weight in a horizontal direction whereby when said movable surface portion is removed from said area, the divider material, packets and weight will fall towards the first surface, means restricting spreading of the individual flats during falling to maintain the position and alignment of the packets, and means for moving said weight to a third position above the second surface.

2. The method of inserting packets of folded box flats in a container which comprises the steps of positioning a container under an opening having a slidable closure, positioning the slidable closure in a closed position, positioning a sheet of divider material on top of the slidable closure remote from the container, positioning packets of flats on the divider material over the slidable closure, positioning a weight on said packets, opening said slidable closure and dropping said divider material, packets and weights into said container, restricting spreading of the box flats during movement of the packets and weight from the area of the opened closure to the container, and thereafter removing said weight from said container to a position above said slidable closure and closing said slidable closure.

3. A device for packaging box flats in a container which comprises a frame device, a first surface associated with said frame device for receiving a container, a second surface carried by said frame device, portions of said second surface being movable to provide an opening in said second surface above a container received on said first surface, vertical walls extending above said second surface defining an area which includes the opening, a movable weight movable from a position above said second surface to a position adjacent said first surface, a plurality of vertical grooves in at least some of said vertical walls, a plurality of shoulders on the periphery of said weight indexible with said grooves, and means for guiding and controlling movement of the weight, the shoulders on the weight having outside end portions thereof which project below a bottom surface of said weight, the bottom surface being parallel with the second surface.

4. The device of claim 3 wherein the weight comprises a perforated plate fixed to the lower end of at least one vertical member guided in a guiding means.

5. The device of claim 4, wherein the said weight comprises an assembly of telescopic parts whereby the horizontal dimensions of the weight are variable, the weight being affixed to at least one vertical bar guided in a guiding means.

* * * * *